US011788774B2

(12) United States Patent
Cheng et al.

(10) Patent No.: US 11,788,774 B2
(45) Date of Patent: Oct. 17, 2023

(54) STIRLING FREEZER

(71) Applicant: NATIONAL CHENG KUNG UNIVERSITY, Tainan (TW)

(72) Inventors: Ching-Hsiang Cheng, Tainan (TW); Shang-Ting Huang, Taichung (TW)

(73) Assignee: National Cheng Kung University, Tainan (TW)

( * ) Notice: Subject to any disclaimer, the term of this patent is extended or adjusted under 35 U.S.C. 154(b) by 121 days.

(21) Appl. No.: 17/392,602

(22) Filed: Aug. 3, 2021

(65) Prior Publication Data

US 2023/0044971 A1 Feb. 9, 2023

(51) Int. Cl.
*F25B 9/14* (2006.01)

(52) U.S. Cl.
CPC ..... *F25B 9/14* (2013.01)

(58) Field of Classification Search
CPC ..... F25B 9/14; F25B 2309/1428
See application file for complete search history.

(56) References Cited

U.S. PATENT DOCUMENTS

2002/0134088 A1* 9/2002 Rudick ..... F28D 15/0266 62/448

FOREIGN PATENT DOCUMENTS

TW I539125 B * 11/2014 ..... F25B 27/00

OTHER PUBLICATIONS

Hsiang, Stirling Heating and Cooling Apparatus, 2014, Full Document (Year: 2014).*

* cited by examiner

*Primary Examiner* — Nael N Babaa
(74) *Attorney, Agent, or Firm* — Rosenberg, Klein & Lee

(57) ABSTRACT

A Stirling freezer includes a cabinet body, at least one power unit, a pipeline, and a plurality of Stirling cooling modules. The cabinet body has a refrigerating space, a cold end space, and a hot end space. The power unit is connected to the pipeline. The Stirling cooling modules each include a pipe and a passive displacer. The passive displacer is reciprocally, movably disposed in the pipe to partition the pipe into a cold end and a hot end. The cold end is located in the cold end space. The hot end is located in the hot end space. The hot end is connected to the pipeline. The cold end absorbs thermal energy of the cold end space to form a low-temperature environment. Air flows between the cold end space and the refrigerating space, so that the refrigerating space also forms a low-temperature environment.

8 Claims, 9 Drawing Sheets

STIRLING FREEZER

FIELD OF THE INVENTION

The present invention relates to a Stirling freezer, and more particularly to a Stirling freezer having multiple Stirling cooling modules with cold ends for cooling.

BACKGROUND OF THE INVENTION

Taiwan Patent No. 527481 discloses a freezing system and a cooling device of a Stirling freezer. The hot zone of the Stirling freezer is equipped with a ring-shaped sleeve. A cylindrical heat-dissipating heat exchanger is arranged around the main body of the Stirling freezer. The sleeve and the heat-dissipating heat exchanger are connected by a pipe to form a closed loop, and the refrigerant is circulated in the closed loop. Thus, the heat in the hot zone is delivered by the refrigerant to effectively dissipate heat from the heat-dissipating heat exchanger, so the required cooling capacity can be stably obtained from the cold zone of the Stirling freezer. However, there is only one cold zone in this patent, and the heat exchange area and the heat transfer rate are too small. Besides, in this patent, the refrigerant is used to deliver the heat in the loop, which often causes a loss of coldness in the loop. If the heat insulation effect is poor, the freezing performance will be reduced.

Taiwan Patent No. 1539125 discloses a Stirling heating and cooling apparatus, comprising a Stirling engine and at least one cooling module. The Stirling engine includes a cylinder and a piston mounted in the cylinder, and is divided into a first working space and a second working space by a first porous material. The cooling module is divided into a third working space and a fourth working space by a second porous material. The piston separates the second working space from the third working space, which prevents a first working gas used in the Stirling engine from interfering or mixing with a second working gas used in the cooling module and optimizes the performance of the apparatus. FIG. 1 of this patent shows the structure of a cooling module driven by a Stirling engine. The cooling end of the cooling module is configured to absorb the ambient heat, thereby reducing the temperature of the environment and achieving a cooling effect. FIG. 11 of this patent shows the structure of multiple cooling modules driven by a Stirling engine. With the multiple cooling modules, the rate of heat transfer is improved. However, only one Stirling engine is used as the power source for the multiple cooling modules, and the cooling rate is limited. It takes a long time to be cooled to the working temperature when an extremely low temperature environment is required, so it is not suitable for those who need rapid cooling. The distance between each cooling module and the Stirling engine is different. As a result, the displacer of each cooling module has a stroke difference. (The displacement stroke is different. For example, in the same cycle, the farther the displacer of the cooling module away from the Stirling engine, the shorter the displacement stroke.) Thus, the farther the distance between the cooling module and the Stirling engine, the greater the phase difference. This will result in that the farther cooling module has a poorer cooling effect. The multiple cooling modules are arranged in a straight line. There is no pressure drop control between the Stirling engine and the pipeline of the multiple cooling modules, so the phase difference cannot be controlled. In addition, the above-mentioned patent relies on high temperature to drive the Stirling engine, not suitable for environments lacking high temperature heat sources.

SUMMARY OF THE INVENTION

In view of the defects of the prior art, the primary object of the present invention is to provide a Stirling freezer. The Stirling freezer comprises a cabinet body, at least one power unit, a pipeline, and a plurality of Stirling cooling modules. The cabinet body has a refrigerating space, a cold end space, and a hot end space. An air inlet and an air outlet are provided between the refrigerating space and the cold end space. A thermal insulating layer is provided between the cold end space and the hot end space. The power unit includes a cylinder and a piston. The pipeline is connected to the cylinder. The Stirling cooling modules each include a pipe and a passive displacer. The passive displacer is reciprocally, movably disposed in the pipe to partition the pipe into a cold end and a hot end. The cold end is located in the cold end space. The hot end is located in the hot end space. The hot end is connected to the pipeline.

The piston is driven to compress air in the cylinder to form a compressed air. The compressed air flows through the pipeline to the hot end and then flows to the cold end through the passive displacer. The cold end absorbs thermal energy of the cold end space to form a low-temperature environment in the cold end space. Air in the refrigerating space flows through the air inlet into the cold end space to be cooled and then flows back to the refrigerating space from the air outlet, so that the refrigerating space also forms a low-temperature environment.

Preferably, an air inlet fan is provided at the air inlet.

Preferably, an air outlet fan is provided at the air outlet.

Preferably, the pipeline is provided with at least one piezoresistive unit. The piezoresistive unit is selectively disposed between the Stirling cooling modules and the cylinder. When the compressed air passes through the piezoresistive unit, a pressure of the compressed air is changed, thereby changing a movement stroke of the passive displacer and a phase difference between the movement strokes of the passive displacers of the Stirling cooling modules. Therefore, by adjusting the pressure drop of the compressed air passing through the piezoresistive unit, the coldness of the cold ends of the respective Stirling cooling modules can be controlled. Preferably, the piezoresistive unit is one of a valve and a porous member. Preferably, the valve is one of a constant temperature expansion valve, a constant pressure expansion valve and a constant flow expansion valve.

Alternatively, the pipeline has at least one diameter-changing portion. The diameter-changing portion is selectively disposed between the Stirling cooling modules and the cylinder. When the compressed air passes through the diameter-changing portion, a pressure of the compressed air is changed, thereby changing a movement stroke of the passive displacer and a phase difference between the movement strokes of the passive displacers of the Stirling cooling modules. Therefore, by controlling the diameter of the diameter-changing portion, the pressure drop of the compressed air passing through the diameter-changing portion can be controlled, and the coldness of the cold ends of the respective Stirling cooling modules can be controlled.

Preferably, the cold ends of the Stirling cooling modules are arranged in a single straight line, multiple straight lines, a radial form, a single circle, multiple circles, or a combination thereof.

Preferably, the refrigerating space and the cold end space are arranged horizontally, vertically, in an alternate manner, or a combination thereof.

Preferably, the power unit is a Stirling engine, or the power unit further includes an electric motor connected to the piston.

Preferably, the cold ends of the Stirling cooling modules are different in size.

Through the above technical features, the following effects are achieved.

1. The Stirling freezer of the present invention has multiple Stirling cooling modules with multiple cold ends, so that the heat exchange area is large, the heat transfer rate is good, and the cold storage effect is better.

2. The air inlet fan and the air outlet fan are provided and configured to circulate the cold air in the cold end space and the refrigerating space of the cabinet body, so as to maintain the coldness of the refrigerating space. There is no need for a refrigerant loop, which reduces the loss of coldness so that the refrigerating space of the cabinet body has a better cooling effect.

3. The cold ends of the Stirling cooling modules of the present invention may be arranged in a single straight line, multiple straight lines, a radial form, a single circle, multiple circles, or a combination thereof. The power unit may be arranged in the center of the multiple Stirling cooling modules. The power unit may be plural. Multiple power units can increase the cooling capacity, thereby meeting the required temperature quickly. The Stirling freezer may be applied to special cold chains (such as vaccine transportation).

4. The refrigerating space and the cold end space of the cabinet body are arranged horizontally, vertically, in an alternate manner, or a combination thereof.

5. The pipeline between the power unit and the multiple Stirling cooling modules is provided with the piezoresistive unit or the diameter-changing portion. By adjusting the fluid pressure of each Stirling cooling module through the corresponding piezoresistive unit or diameter-changing portion, the passive displacer of each Stirling cooling module has a controllable movement stroke, so that each Stirling cooling module has a controllable cooling effect. For example, the passive displacer of each Stirling cooling module can be controlled to have the same movement stroke, so that each Stirling cooling module has a consistent cooling effect; or the refrigerating space is divided into a general refrigerating space and a freezing space to provide different cooling effects.

6. The power unit uses the electric motor to drive the piston, thereby overcoming the shortcoming of requiring a high-temperature heat source for operation.

DESCRIPTION OF THE PREFERRED EMBODIMENTS

Embodiments of the present invention will now be described, by way of example only, with reference to the accompanying drawings.

Figure 1:
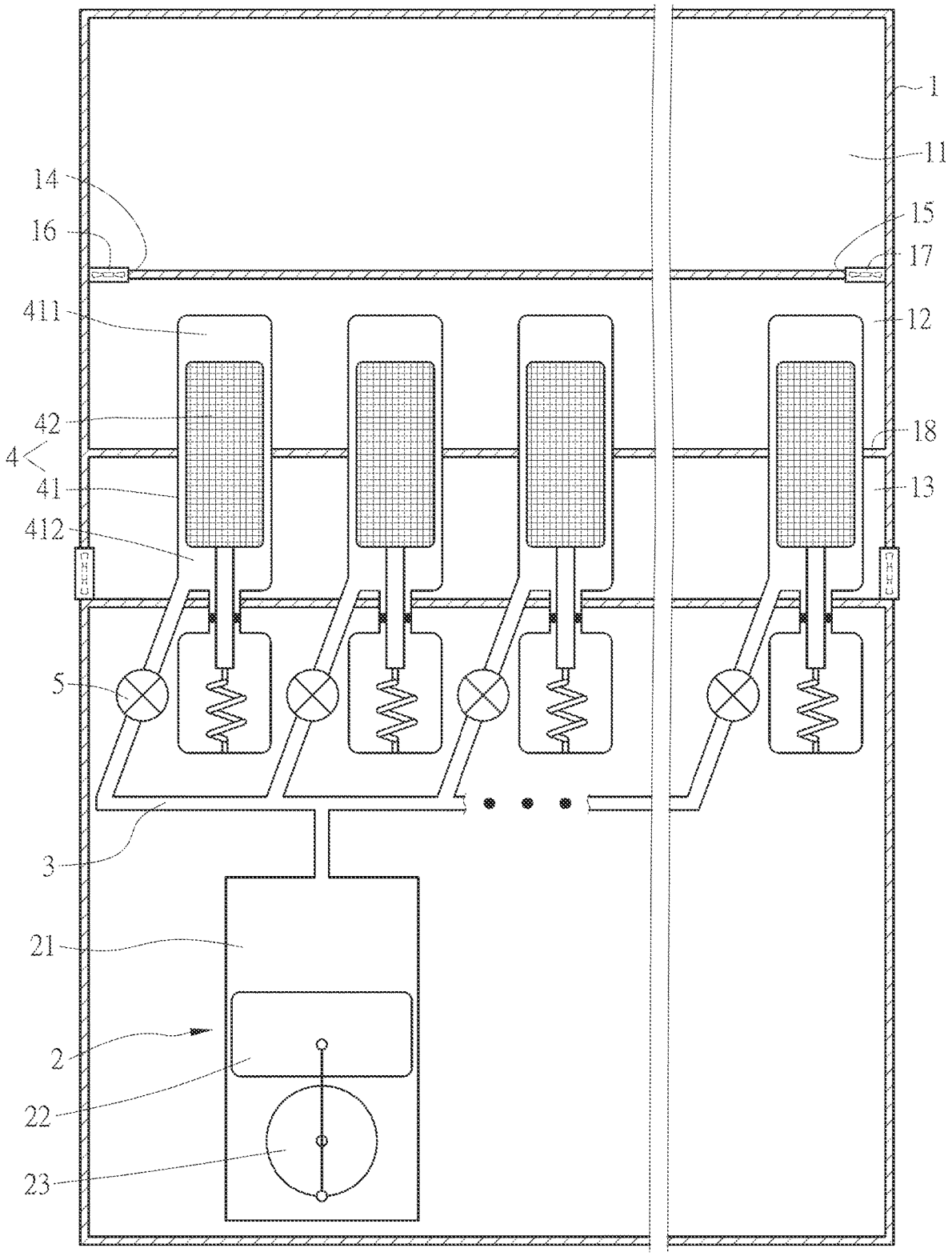
FIG. 1 is a schematic view of the Stirling freezer according to the present invention, wherein the refrigerating space and the cold end space of the cabinet body are arranged horizontally.

As shown in FIG. 1, a Stirling freezer according to an embodiment comprises a cabinet body 1, at least one power unit 2, a pipeline 3, a plurality of Stirling cooling modules 4, and a plurality of piezoresistive units 5. The cabinet body 1 has a refrigerating space 11, a cold end space 12, and a hot end space 13. The refrigerating space 11 and the cold end space 12 are disposed one on top of another and arranged horizontally. An air inlet 14 and an air outlet 15 are provided between the refrigerating space 11 and the cold end space 12. An air inlet fan 16 is provided at the air inlet 14, and an air outlet fan 17 is provided at the air outlet 14. A thermal insulating layer 18 is provided between the cold end space 12 and the hot end space 13. The power unit 2 includes a cylinder 21 and a piston 22. The power unit 2 may be a Stirling engine. In this embodiment, the power unit 2 further includes an electric motor 23 for driving the piston 22, so that there is no need for a hot end to drive the heat engine, suitable for various use environments. The pipeline 3 is connected to the cylinder 21. Each Stirling cooling module 4 includes a pipe 41 and a passive displacer 42. The passive displacer 42 is reciprocally, movably disposed in the pipe 41 to partition the pipe 41 into a cold end 411 and a hot end 412. The cold end 411 is located in the cold end space 12. The hot end 412 is located in the hot end space 13, and the hot end 412 is connected to the pipeline 3. The piezoresistive units 5 are disposed on the pipeline 3, and are selectively disposed between the Stirling cooling modules 4 and the cylinder 21. In this embodiment, the piezoresistive unit 5 is provided between each of the Stirling cooling modules 4 and the cylinder 21. The piezoresistive unit 5 may use, for example, a valve or a porous member. The valve may use, for example, a constant temperature expansion valve, a constant pressure expansion valve or a constant flow expansion valve.

The piston 22 is driven by the electric motor 23 to compress the air in the cylinder 21 to form a compressed air. The compressed air flows through the pipeline 3 to the hot end 412, and then flows to the cold end 411 through the passive displacer 42. The cold end 411 absorbs the thermal energy of the cold end space 12, thereby forming a low-temperature environment in the cold end space 12. The air in the refrigerating space 11 flows through the air inlet 14 into the cold end space 12 to be cooled, and then flows back to the refrigerating space 11 from the air outlet 15, so that the refrigerating space 11 also forms a low-temperature environment. The air inlet fan 16 and the air outlet fan 17 are activated and configured to circulate the cold air in the cold end space 12 and the refrigerating space 11, so as to keep the coldness of the refrigerating space 11. The compressed air absorbs the thermal energy at the cold end 411 to increase the temperature, and is expanded to flow back to the hot end 412 and the cylinder 21 through the passive displacer 42 to form a complete thermodynamic cycle. Since the cold end space 12 is adjacent to the hot end space 13, the thermal insulating layer 18 is provided between the cold end space 12 and the hot end space 13. This embodiment of the present invention does not use a refrigerant loop, which reduces the loss of coldness so that the refrigerating space 11 of the cabinet body 1 has a better cooling effect. This embodiment of the present invention has multiple Stirling cooling modules 4 with multiple cold ends 411, so that the heat exchange area is large, the heat transfer rate is good, and the cold storage effect is better.

When the compressed air enters the pipe 41 of each Stirling cooling module 4, the pressure drop can be adjusted through the piezoresistive unit 5 between each Stirling cooling module 4 and the cylinder 21. When the compressed air enters the hot end 412 of the pipe 41 of each Stirling cooling module 4, it has the same pressure, so that the passive displacer 42 of each Stirling cooling module 4 has a movement stroke that tends to be uniform, so as to have a cooling effect that tends to be uniform. Alternatively, according to different cooling requirements, different pressure drops are adjusted through the piezoresistive unit 5, so that the cold end 411 of the pipe 41 of each Stirling cooling module 4 has a different cooling effect. For example, the refrigerating space 11 is divided into a general refrigerating space and a freezing space to provide different cooling effects. That is, in this embodiment, the passive displacer 42 of each Stirling cooling module 4 has a controllable movement stroke, so that the cold end 411 of each Stirling cooling module 4 has a controllable cooling effect.

Figure 2:
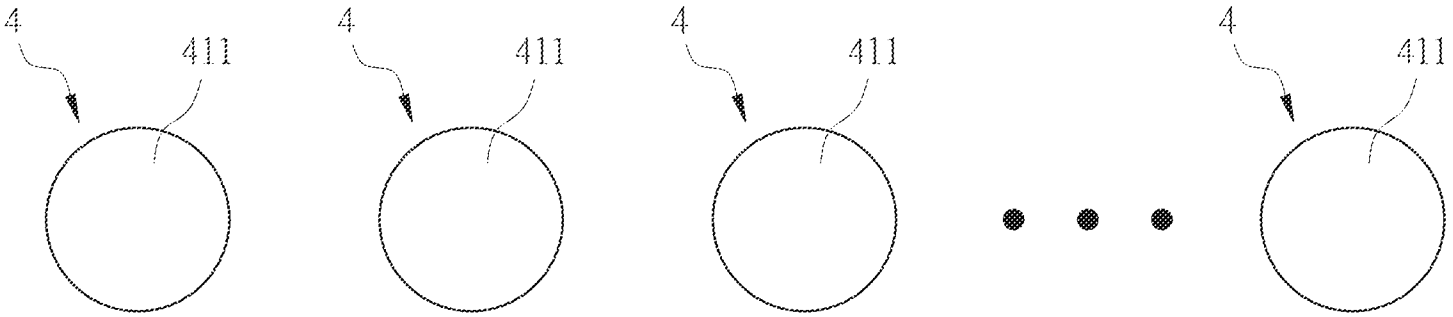
FIG. 2 is a schematic view according to the present invention, illustrating that the Stirling cooling modules of the Stirling freezer are arranged in a straight line.
Figure 3:
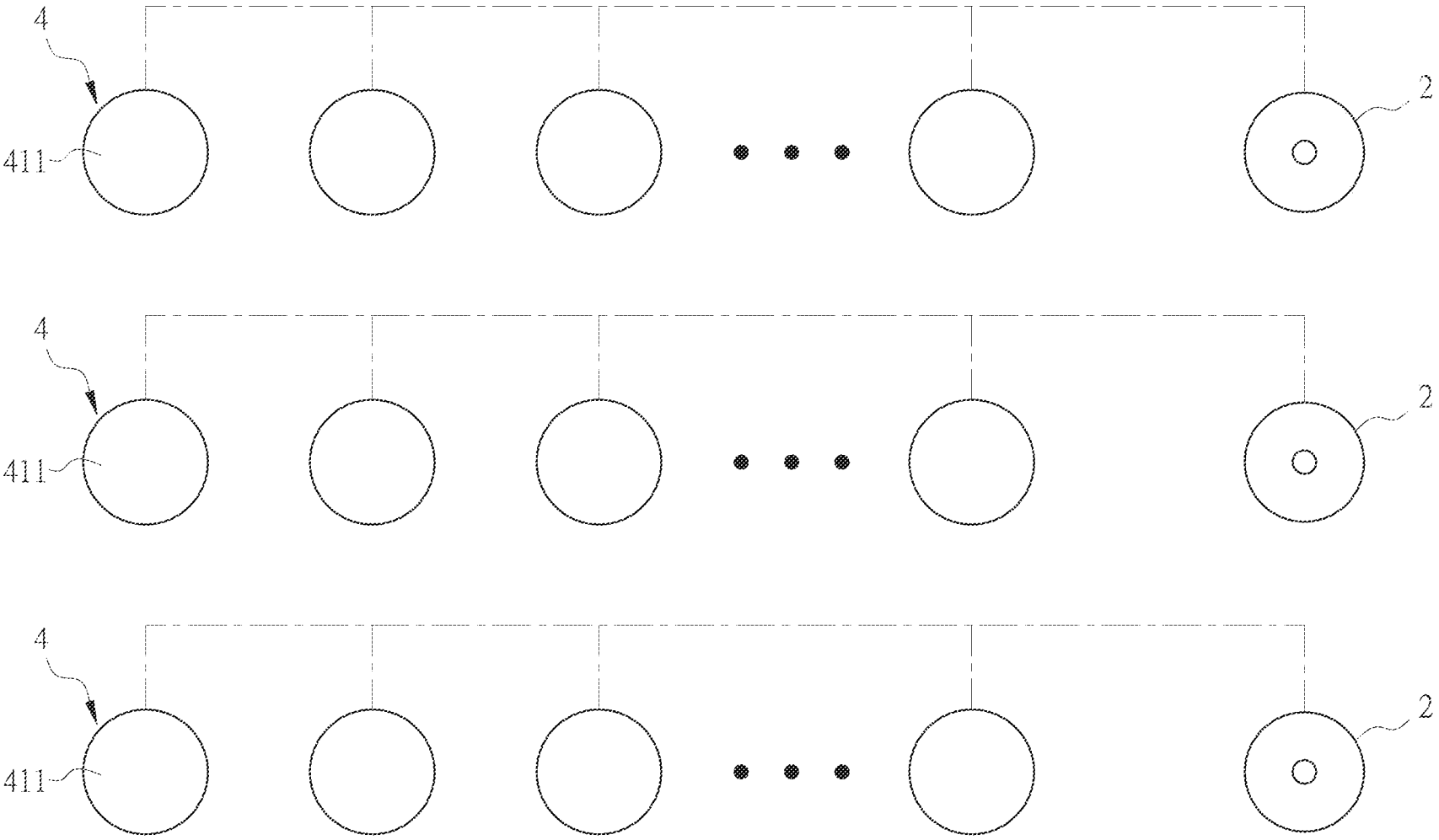
FIG. 3 is a schematic view according to the present invention, illustrating that the Stirling cooling modules of the Stirling freezer are arranged in multiple straight lines.
Figure 4:
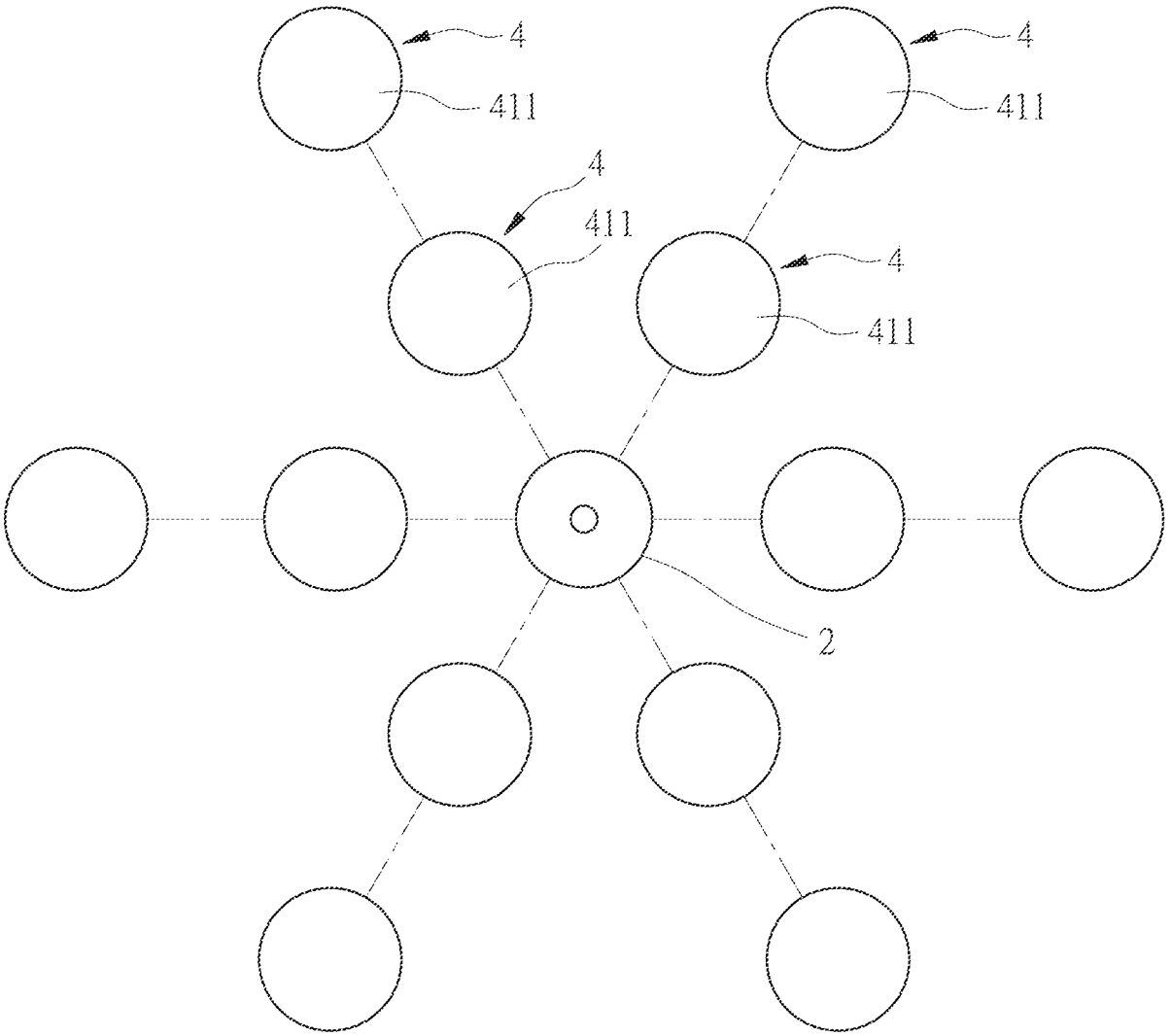
FIG. 4 is a schematic view according to the present invention, illustrating that the Stirling cooling modules of the Stirling freezer are arranged radially.
Figure 5:
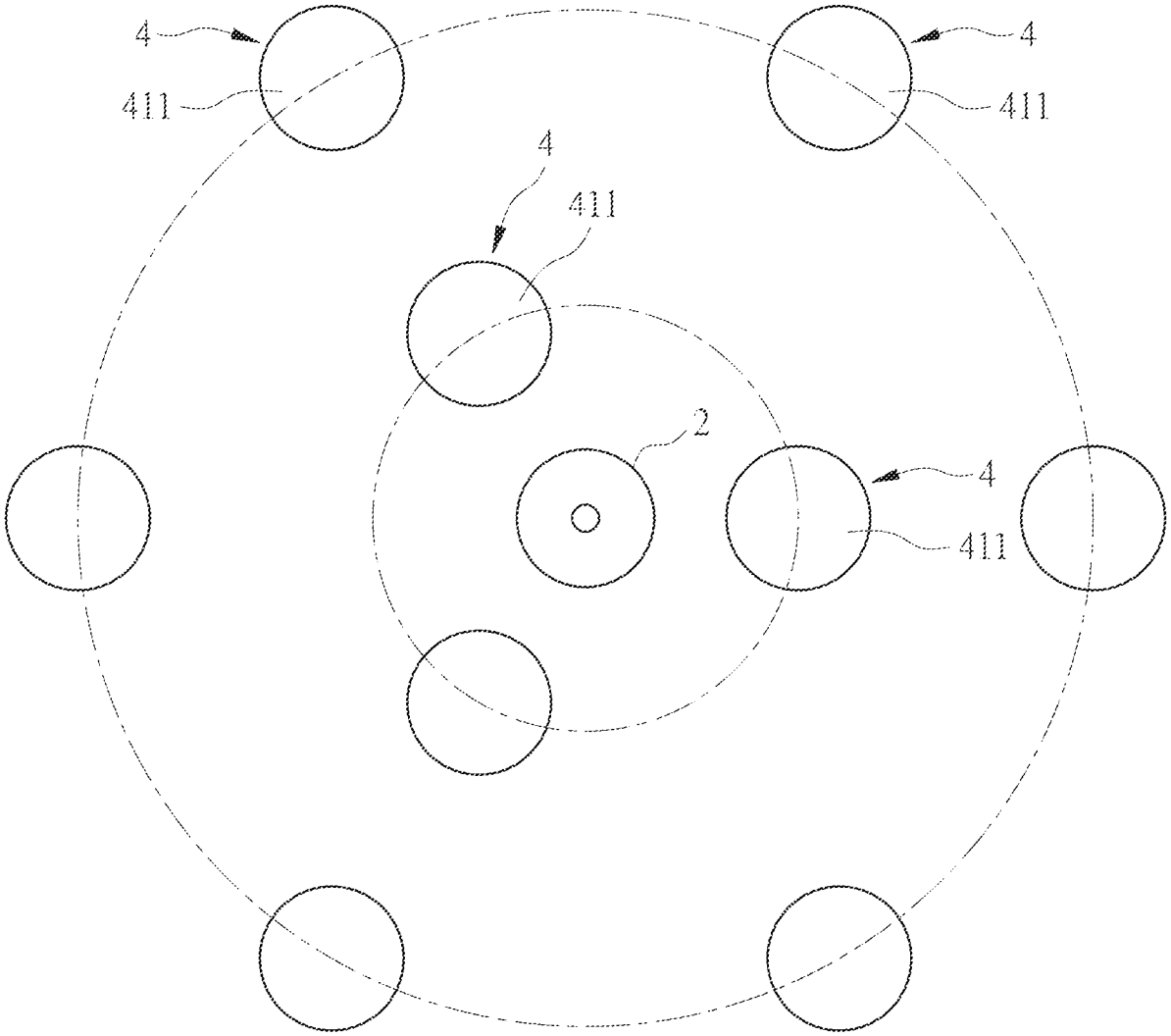
FIG. 5 is a schematic view according to the present invention, illustrating that the Stirling cooling modules of the Stirling freezer are arranged in multiple circles.

Referring to FIGS. 2 to 5, according to different cooling requirements (such as the size, compartment and shape of the cooling space), the cold ends 411 of the Stirling cooling modules 4 may be arranged in different ways. For example, they are arranged in a single straight line as shown in FIG. 2 or arranged in multiple straight lines as shown in FIG. 3. They may be arranged radially as shown in FIG. 4, or arranged in multiple circles as shown in FIG. 5 (or arranged in a single circle), or they are arranged arbitrarily. As shown in FIG. 3, the power unit 2 may be plural according to the needs, or as shown in FIG. 4 and FIG. 5, the power unit 2 may be arranged in the center of the multiple Stirling cooling modules 4.

Figure 6:
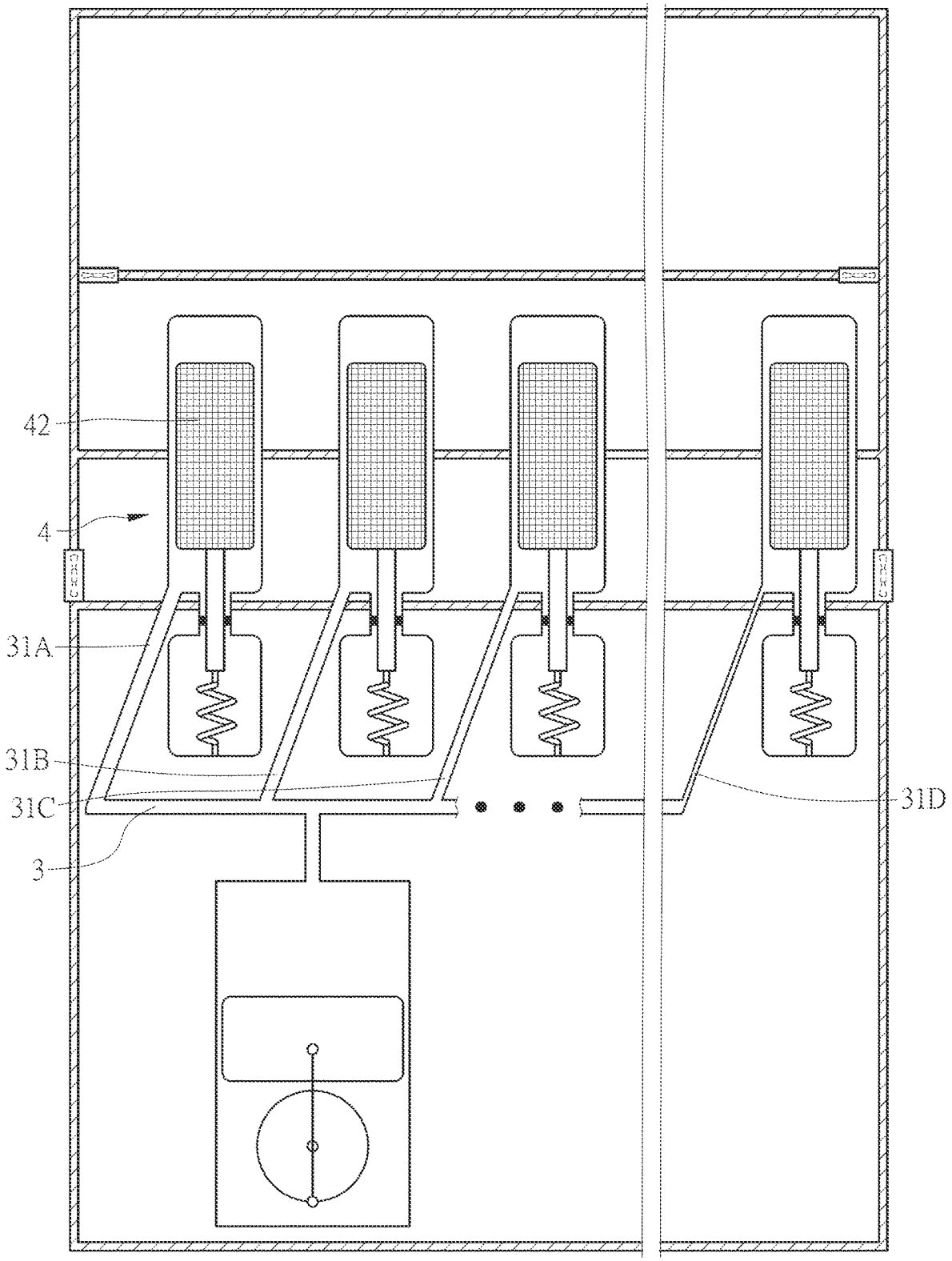
FIG. 6 is a schematic view of the Stirling freezer according to the present invention, wherein the diameter-changing portion of the pipeline is disposed between each Stirling cooling module and the cylinder.

Referring to FIG. 6, in addition to using the piezoresistive unit 5 to adjust the pressure drop of the Stirling cooling module 4, the pipeline 3 may have at least one diameter-changing portion 31A, 31B, 31C, 31D. When the compressed air passes through the diameter-changing portion 31A, 31B, 31C, 31D, the pressure of the compressed air is changed. Thus, the pressure drop of each Stirling cooling module 4 is adjusted to change the phase difference between the movement strokes of the passive displacers 42 of the Stirling cooling modules 4, and the cooling effect of each Stirling cooling module 4 can be controlled.

Figure 7:
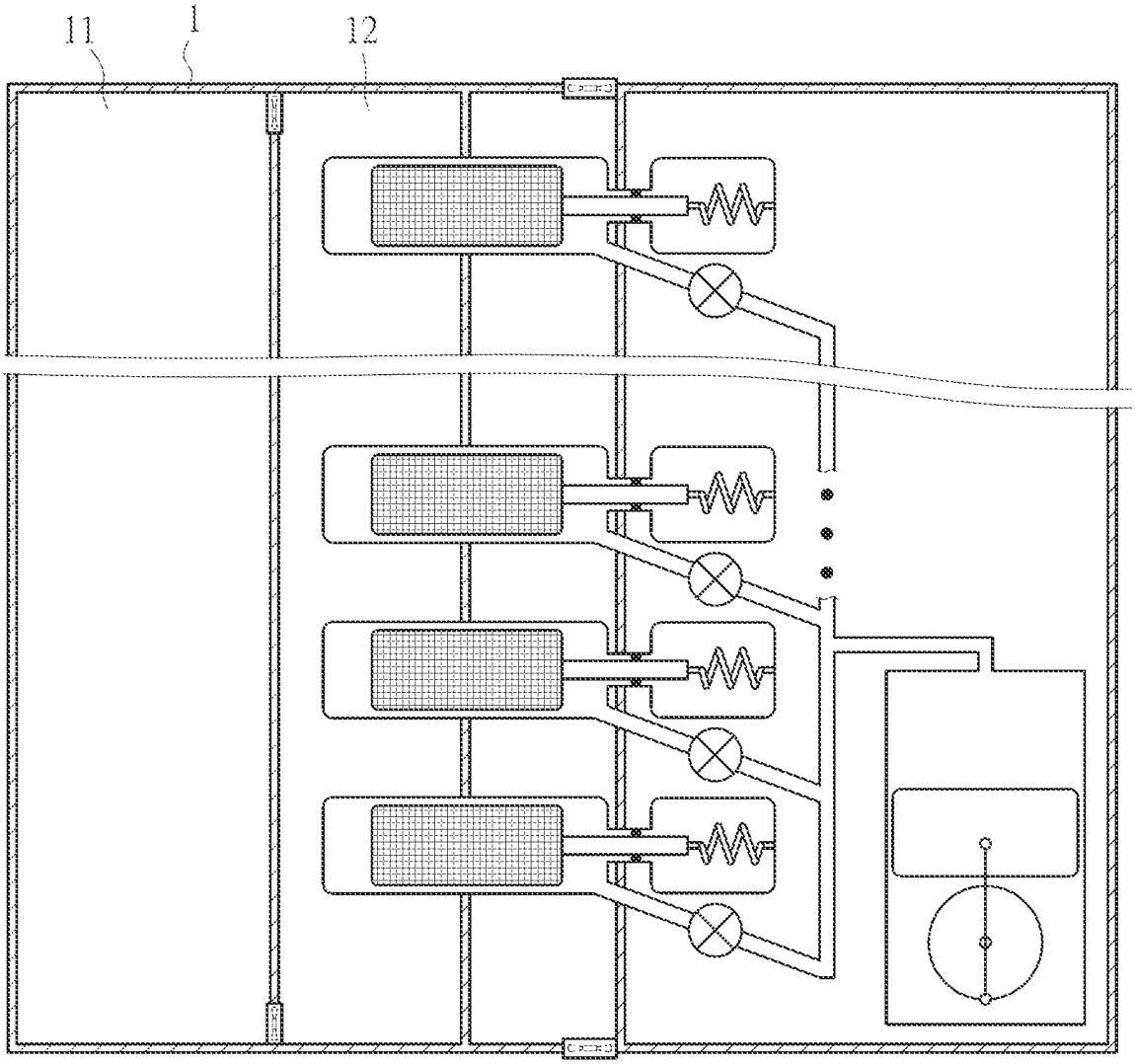
FIG. 7 is a schematic view of the Stirling freezer according to the present invention, wherein the refrigerating space and the cold end space of the cabinet body are arranged vertically.
Figure 8:
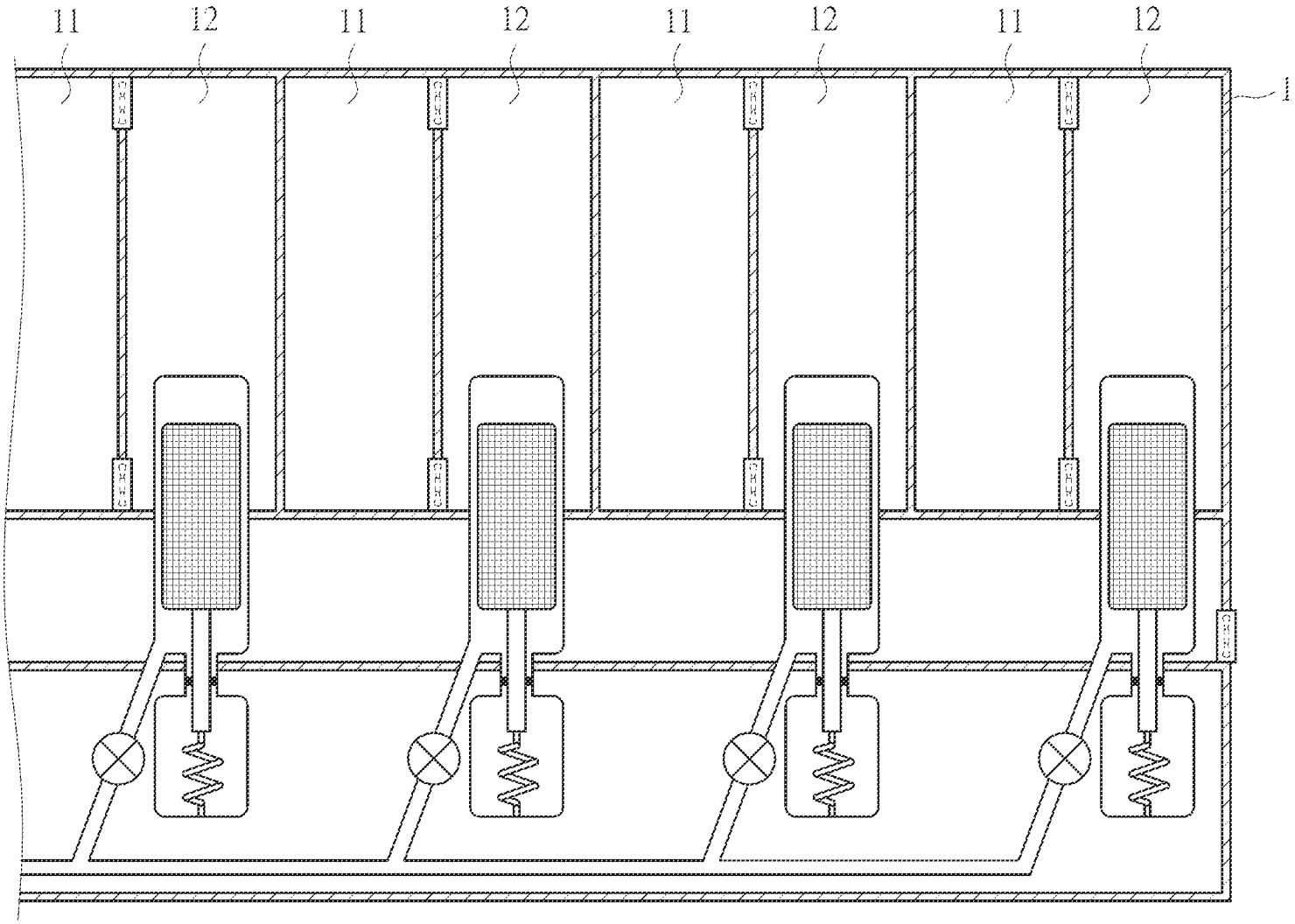
FIG. 8 is a schematic view of the Stirling freezer according to the present invention, wherein the refrigerating space and the cold end space of the cabinet body are arranged in an alternate manner.

Referring to FIG. 7, the refrigerating space 11 and the cold end space 12 of the cabinet body 1 may be arranged vertically according to different places of use. Alternatively, as shown in FIG. 8, the refrigerating space 11 and the cold end space 12 of the cabinet body 1 may be arranged in an alternate manner.

Figure 9:
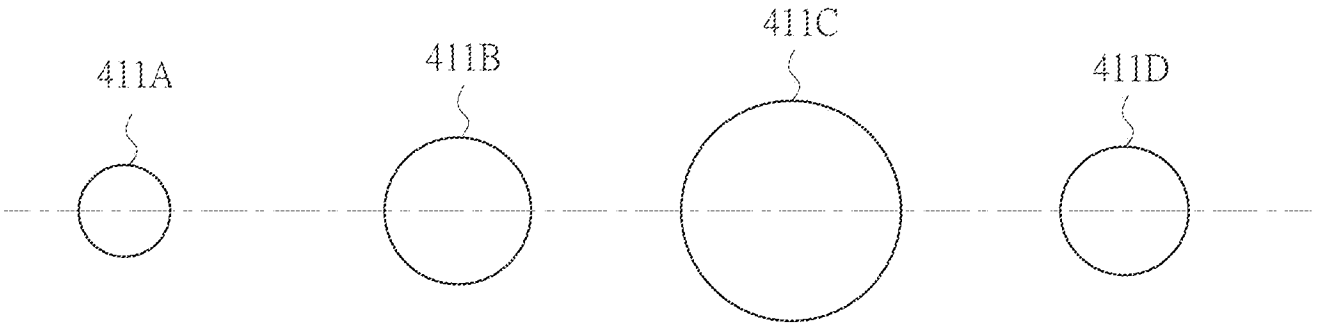
FIG. 9 is a schematic view according to the present invention, illustrating that the cold ends of the Stirling cooling modules are different in size.

As shown in FIG. 9, in the Stirling freezer of this embodiment, the sizes of the cold ends 411A, 411B, 4110, 411D of the Stirling cooling modules are different. Therefore, the cold ends 411A, 411B, 411C, 411D in different sizes can be selected according to the size of the cooling space. For example, when the cooling space is large, the large-sized cold end 411C can be selected; when the cooling space is small, the small-sized cold end 411A can be selected.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A Stirling freezer, comprising:

a cabinet body, having a refrigerating space, a cold end space and a hot end space, an air inlet and an air outlet being provided between the refrigerating space and the cold end space, a thermal insulating layer being provided between the cold end space and the hot end space;

at least one power unit, including a cylinder and a piston;

a pipeline, connected to the cylinder;

a plurality of Stirling cooling modules, each including a pipe and a passive displacer, the passive displacer being reciprocally, movably disposed in the pipe to partition the pipe into a cold end and a hot end, the cold end being located in the cold end space, the hot end being located in the hot end space, the hot end being connected to the pipeline;

wherein the piston is driven to compress air in the cylinder to form a compressed air, the compressed air flows through the pipeline to the hot end and then flows to the cold end through the passive displacer, the cold end absorbs thermal energy of the cold end space to form a low-temperature environment in the cold end space, air in the refrigerating space flows through the air inlet into the cold end space to be cooled and then flows back to the refrigerating space from the air outlet, so that the refrigerating space also forms a low-temperature environment, and wherein the pipeline is provided with at least one piezoresistive unit, the piezoresistive unit is selectively disposed between the Stirling cooling modules and the cylinder, when the compressed air passes through the piezoresistive unit, a pressure of the compressed air is changed, thereby changing a movement stroke of the passive displacer and a phase difference between the movement strokes of the passive displacers of the Stirling cooling modules.

2. The Stirling freezer as claimed in claim 1, wherein an air inlet fan is provided at the air inlet, and an air outlet fan is provided at the air outlet.

3. The Stirling freezer as claimed in claim 1, wherein the piezoresistive unit is one of a valve and a porous member.

4. The Stirling freezer as claimed in claim 3, wherein the valve is one of a constant temperature expansion valve, a constant pressure expansion valve and a constant flow expansion valve.

5. The Stirling freezer as claimed in claim 1, wherein the cold ends of the Stirling cooling modules are arranged in a single straight line, multiple straight lines, a radial form, a single circle, multiple circles, or a combination thereof.

6. The Stirling freezer as claimed in claim 1, wherein the refrigerating space and the cold end space are arranged horizontally, vertically, in an alternate manner, or a combination thereof.

7. The Stirling freezer as claimed in claim 1, wherein the power unit is a Stirling engine, or the power unit further includes an electric motor connected to the piston.

8. The Stirling freezer as claimed in claim 1, wherein the cold ends of the Stirling cooling modules are different in size.

* * * * *